United States Patent [19]

Miller et al.

[11] 3,931,778

[45] Jan. 13, 1976

[54] SUPPORT BARGE METHOD AND APPARATUS

[75] Inventors: Edward E. Miller; Eberhard V. Ranft, both of Houston, Tex.

[73] Assignee: Raymond International, Inc., Houston, Tex.

[22] Filed: Aug. 8, 1974

[21] Appl. No.: 495,909

[52] U.S. Cl. ..... 114/26; 61/30; 114/43.5 R

[51] Int. Cl.[2] ..... B63B 35/28; E02B 7/08

[58] Field of Search ..... 114/0.5 R, 26, 31, 43.5 AC, 114/43.5 R, 70, 75; 61/30; 115/1 B; 187/9 R

[56] References Cited

UNITED STATES PATENTS

| | | | |
|---|---|---|---|
| 143,808 | 10/1873 | Cass | 114/70 |
| 2,349,930 | 5/1944 | Atkinson | 114/43.5 |
| 2,568,330 | 9/1951 | Flippin | 114/0.5 |
| 2,732,087 | 1/1956 | Pratt | 187/9 X |
| 2,887,235 | 5/1959 | Ladner | 212/15 |
| 3,274,967 | 9/1966 | Igave et al. | 114/75 |
| 3,483,572 | 6/1971 | Tax | 212/15 |
| 3,645,405 | 2/1972 | Stiglich | 212/3 |
| 3,845,631 | 9/1972 | Malan | 61/30 |

*Primary Examiner*—Trygve M. Blix
*Assistant Examiner*—Sherman D. Basinger
*Attorney, Agent, or Firm*—Fitzpatrick, Cella, Harper & Scinto

[57] ABSTRACT

A machinery supporting arrangement suitable for use in maintenance and repair of dam walls comprising a barge with a liftable platform for carrying the machinery. The platform extends out over the top of a dam wall when the barge is moored alongside it so that the machinery becomes supported in part by the dam wall and in part by the barge.

4 Claims, 9 Drawing Figures

12
14
16
18
18a
20
22
29
32
34
40
56

SUPPORT BARGE METHOD AND APPARATUS

BACKGROUND OF THE INVENTION

1. Field of the Invention

This invention relates to temporary supporting arrangements and more particularly it concerns the stable positioning of heavy structures on or near a water retaining wall, such as a dam wall.

The invention is particularly suited for use in dam reinforcement operations wherein heavy machinery, such as drilling rigs and the like, must be maintained accurately positioned atop a rather narrow dam wall. In dam reinforcement operations holes are drilled down through the entire height of the dam wall and down into the underlying bedrock. Anchor rods are then placed into the bedrock and secured thereto. These anchor rods extend up through the top of the dam wall; and threaded nuts or equivalent means are provided to pull up on the anchor rods to place them in tension while pressing down on the top of the dam wall to place it in compression and to hold it solidly in place. In some cases grout is forced down into the drilled holes.

2. Description of the Prior Art

In the past, dam drilling operations were carried out either by mounting the drilling machinery on the dam wall itself or by mounting the drilling machinery on a barge anchored or moored next to the dam wall. Neither of these two arrangements was satisfactory, however. In the case where the drilling machinery was mounted on the dam wall itself, a problem of stability existed. This occured because the dam wall was usually not of sufficient width to allow the machinery to rest on it without extensive framework support. In the case where the drilling machinery was mounted on a barge it was difficult, due to water movements and changes in water level, to maintain accurate positioning at all times of the drilling machinery with respect to the dam wall during a drilling operation. Steady and accurate positioning of the drilling machinery is necessary to keep the drilled hole straight and plumb and to prevent binding and possible loss of the drilling tool.

SUMMARY OF THE INVENTION

According to the present invention the above described problems of the prior art are avoided by means of novel arrangements which permit heavy drilling machinery to be maintained accurately in position over a dam wall during a repair and maintenance or reinforcement operation. Moreover the arrangements employed in carrying out the present invention are relatively inexpensive and are easy to execute.

In one aspect the present invention involves a barge having means for mooring it so that one edge lies adjacent a dam wall. The barge carries a platform having a projecting portion which extends out beyond the one edge of the barge, and means are provided on the barge to lift the platform up from the upper surface of the barge. Drilling or other machinery to be used in dam repair of reinforcing work is carried on the platform.

When the barge is brought alongside the dam wall the platform is raised so that its projecting portion is higher than and extends over the dam wall. After the barge is moored in place the platform is lowered until its extended out portion rests on top of the dam wall. At this point the platform is supported in part by the barge and in part by the dam itself. The machinery then may be brought into operation on the dam wall; and during this movement and subsequent operation of the machinery it is stably supported without imposing undue stress on the dam wall and without affecting the buoyant stability of the barge.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein:

FIG. 3 is an enlarged view taken along line 3—3 of FIG. 1;

DETAILED DESCRIPTION OF PREFERRED EMBODIMENT

Figure 1:
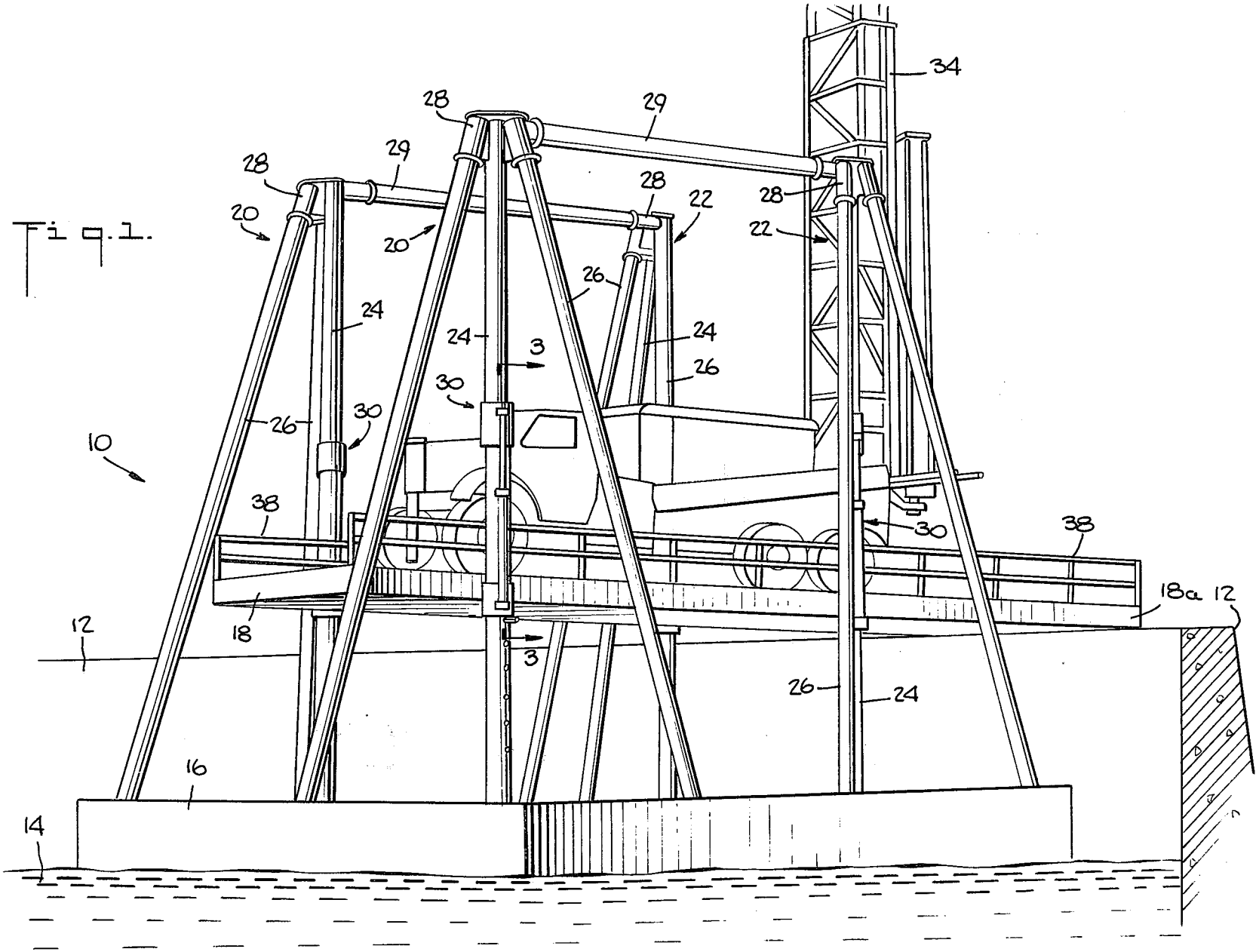
FIG. 1 is a perspective view showing a dam reinforcement barge system, in which the present invention is embodied, in position alongside a dam wall.

In the perspective view of FIG. 1 a barge system 10 is positioned alongside a dam wall 12. The dam wall holds back a body of water 14 in which the barge system floats.

The barge system 10 comprises a hull 16 on which is supported a horizontally extending vertically moveable equipment platform 18. As shown, the platform 18 has an extension **18*a* which projects out beyond the edge of the hull which lies adjacent the dam wall 12. During a repair operation, the extension 18*a* rests on top of the dam wall 12**.

The equipment platform 18 extends between and is supported by a pair of a pair of rear lift and support assemblies 20 and a pair of forward lift and support assemblies 22. These lift and support assemblies each comprise a vertical column 24 and a pair of elongated tilted batter braces 26. The associated braces and vertical column of each assembly are spaced apart from each other on the hull 16 and they are secured together at their upper ends by a connector element 28. A pair of upper horizontal braces 29 interconnect the forward and rearward connector element of each assembly. The equipment platform 18 is connected to the vertical columns 24 by means of hydraulic lift assemblies 30 described more fully hereinafter.

Figure 2:
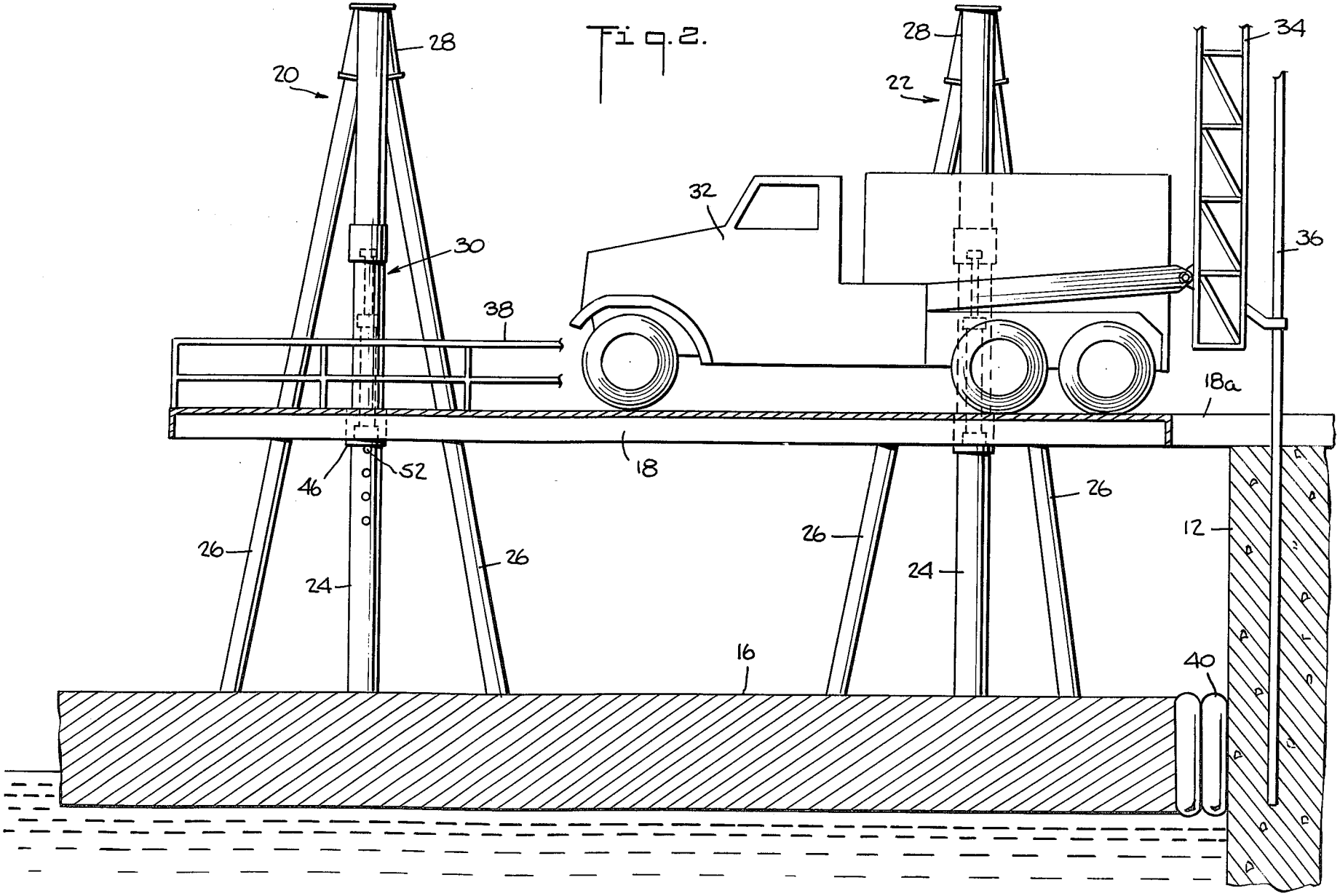
FIG. 2 is a side elevational view, partially in section, of the barge system of FIG. 1.

As can be seen in FIGS. 1 and 2, a truck 32 is carried on the equipment platform 18. The truck 32 in turn carries drilling equipment including a drilling tower 34 for use in drilling holes down through the dam wall 12. The truck may be driven back and forth on the equipment platform to position the drilling tower 34 accurately over the location of each hole to be drilled. As can be seen in FIG. 2, a drill 36 supported by the drilling tower drills straight down through the dam wall; and if necessary, it may continue down to the underlying bedrock. By varying the angle of the drill mast, it is also possible to drill holes in any desirable batter position. A pair of quardrails 38 on the sides of the platform 18 are provided for safety.

The barge hull 16, as shown in FIG. 2 abuts against the dam wall 12 and is cushioned thereagainst by means of a bumper 40.

The hydraulic lift assemblies 30 as shown in FIG. 3 each include an upper sleeve 42 and a lower sleeve 46, both slideable up and down the vertical column 24. The lower sleeve 46 is pivotly connected to the equipment platform 18. A double acting hydraulic piston and cylinder assembly 48 is provided with one end connected to the upper sleeve 42 and the other end connected to the lower sleeve 46. The hydraulic piston and cylinder assemblies are operated in unison by means of a hydraulic circuit (not shown) to raise and lower the equipment platform. The level condition of the platform can, of course, be controlled by selective adjustment of one or two of the hydraulic lift assemblies.

As can be seen in FIG. 3 there are provided a number of holes 50 spaced apart along the length of the the vertical columns 24. As the hydraulic piston and cylinder assemblies 48 are extended, the upper sleeves 42 are pushed up along the vertical columns 24. The pins 44 are then slipped into the holes 50 just under the upper sleeves 42 to prevent the upper sleeves from sliding down.

By now retracting the hydraulic piston and cylinder assemblies 48 with the upper sleeves 42 pinned, the platform 18 is raised through the distance of the cylinder stroke. After now pinning the lower sleeves 46 with pins 52, the lower sleeves are prevented from sliding down; and by extending the piston and cylinder assemblies once again, the upper sleeves slide up columns 24 another increment equal to the distance of the cylinder stroke. By repeating the described steps, the platform can be raised in increments of the cylinder stroke from its lowest to its highest position and lowered by the same steps in reversed order.

For fine adjustments, the cylinder and piston assemblies are retracted partially only and the pins 52 are inserted in holes 50 under sleeves 46 near the desired elevation of platform 18. After these pins are placed, the hydraulic piston and cylinder assembly 48 may be adjusted to allow the lower sleeves to rest on the pins. This permits solid support for the platform 18 to the particular height to which it has been raised and at the same time it relieves stress from the hydraulic piston and cylinder assembly.

Reverting now to FIG. 2 it will be seen that in the operative position of the barge system 10 adjacent the dam wall 12, the pins 52 are present only at the lower sleeves 46 on the rearward vertical columns 24. All pins on the forward verticial columns 24 are removed allowing free movement of the hydraulic lift assemblies along this column. Through this arrangement one end of the equipment platform 18 is supported by the pins 52 on the rearward vertical column 24 only while the opposite end of the platform is supported by the dam wall 12 itself. Hence, no load can be transferred through the forward vertical columns 24, it must be transmitted through platform 18 and the rearward vertical columns into the barge hull 16 its center of flotation. With this support arrangement the platform 18 is held quite stably; and the truck 32 may be moved without imposing undue stresses on the dam wall and without tilting the barge.

Figures 4, 5, 6:
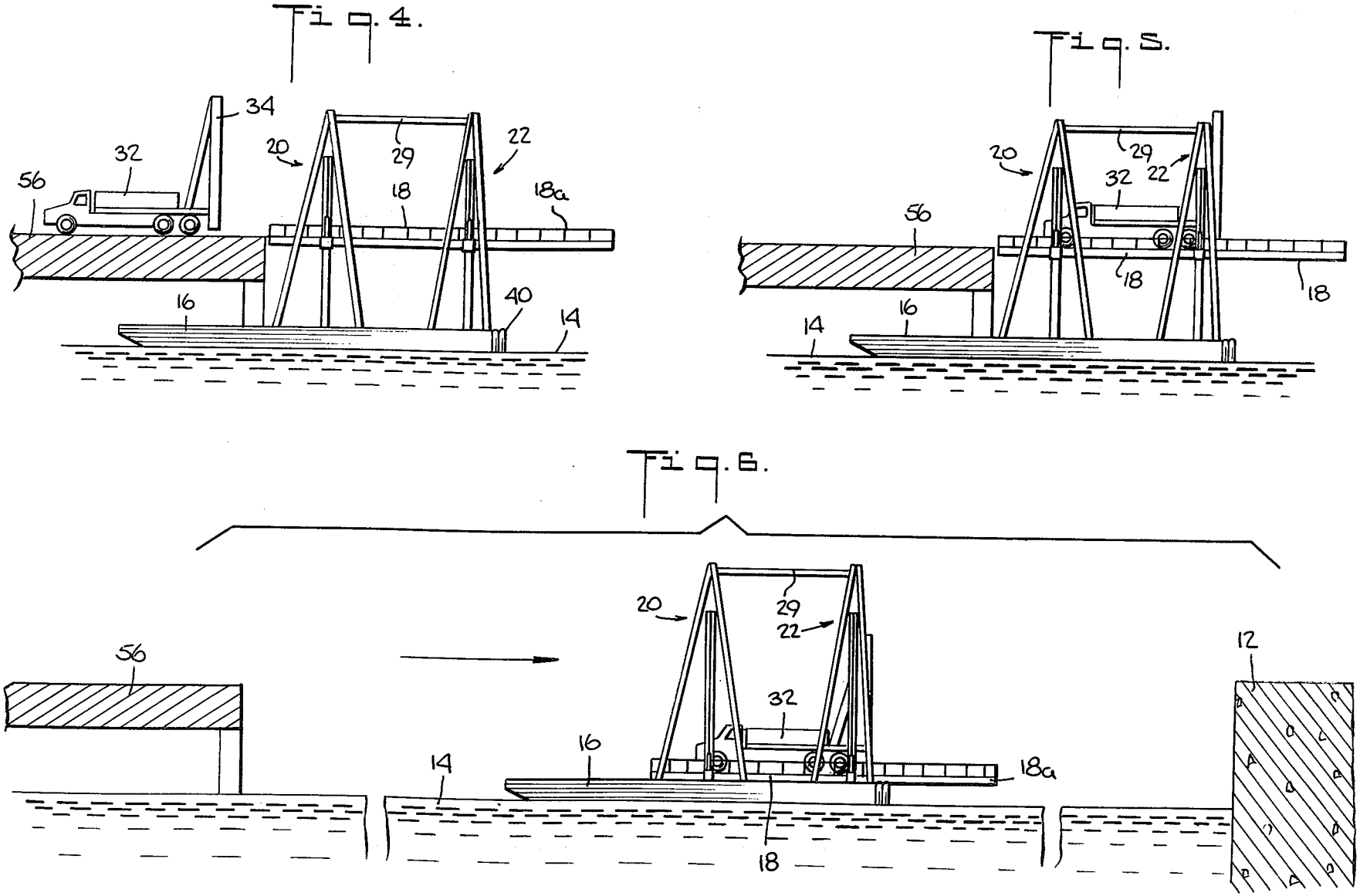

FIGS. 4–8 illustrate how the above described barge system is utilized to transport dam repair equipment and to position it for operation on a dam wall. As can be seen in FIG. 4 the barge system 32 is moored alongside a dock 56 and the equipment platform 18 is raised, as above described, to the height of the dock. The truck 32 and any other equipment needed for dam repair operations is then driven onto the barge system as shown in FIG. 5. Preferably the heavier portions of this equipment for example the truck 32 is positioned centrally between the rear and forward lift and support assemblies 20 and 22 so that the stresses imposed on them will be equalized. Also the positioning of the equipment should coincide with the buoyancy characteristics of the barge hull 16 so that it will float level in the water. In some cases it may be advisable to lower the equipment platform part way or all the way to the hull 16 to promote stability. Thereafter, as shown in FIG. 6 the barge system, with the repair equipment aboard, is floated to the dam wall 12.

Figure 7:
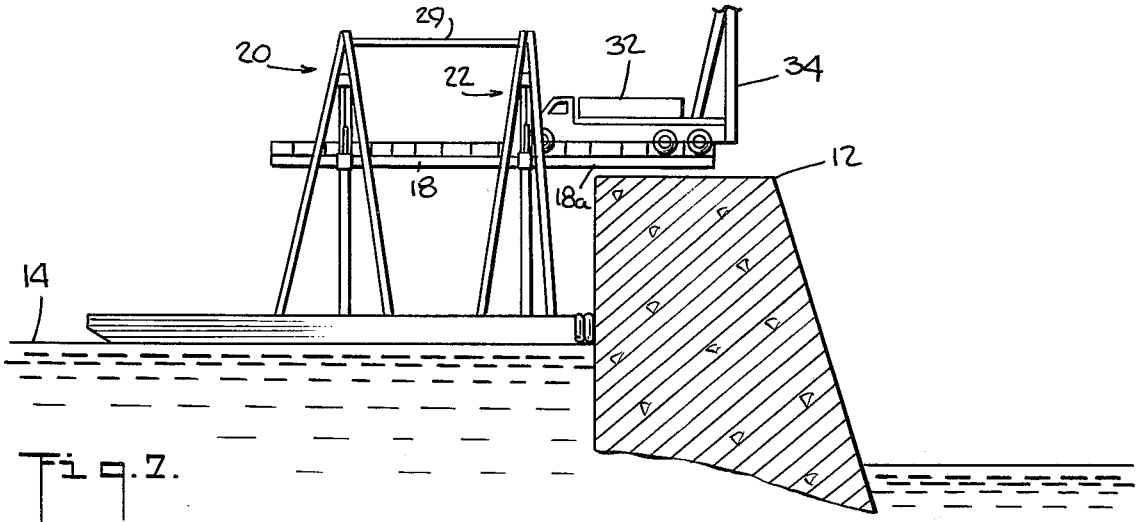
FIGS. 4–8 are outline views in side elevation showing, respectively, the positioning of the barge system of FIG. 1, at a loading dock, the loading of equipment onto the barge, the transport of the barge to a dam for repair and the positioning and securing of the barge for operation on a dam wall.
Figure 8:
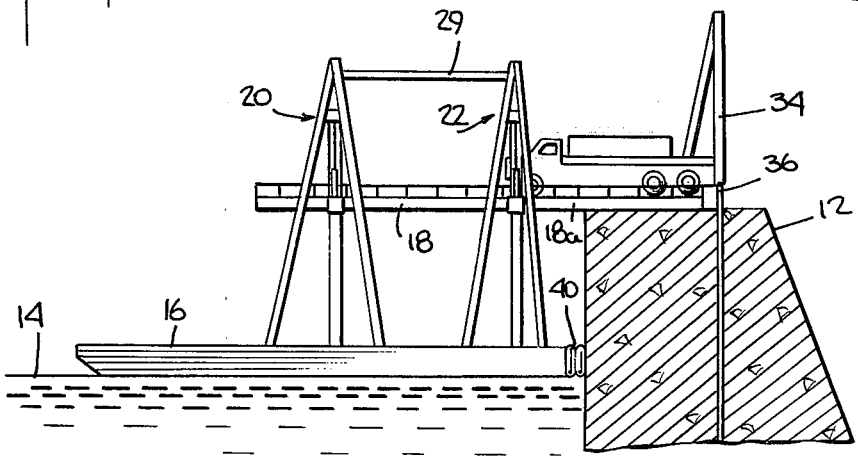

When the barge sytem approached the dam wall 12 the hydraulic piston and cylinder assemblies are actuated to raise the equipment platform 18 so that its extension 18*a* is slightly higher than the top of the dam wall 12. The barge is then moved in toward the dam wall so that the platform extension projects over the wall as shown in FIG. 7. The barge is then moored to the wall, the pins 52 and 44 are removed from the vertical columns 24 of the forward lift and support assemblies 22 and the platform is lowered until the extension 18*a* comes to rest on top of the wall. At this point the platform 18 is supported at one end of the rear support and lift assembly 20 and at the other end by the dam wall 12 itself. The truck 32 may then be driven back into position for work on the dam wall as shown in FIG. 8. Since the lower sleeves 46 are pivotly connected to the platform 18, the whole barge system 10 can undergo certain changes due to water level fluctuations without causing twisting or binding of the sleeves and columns 24.

Figure 9:
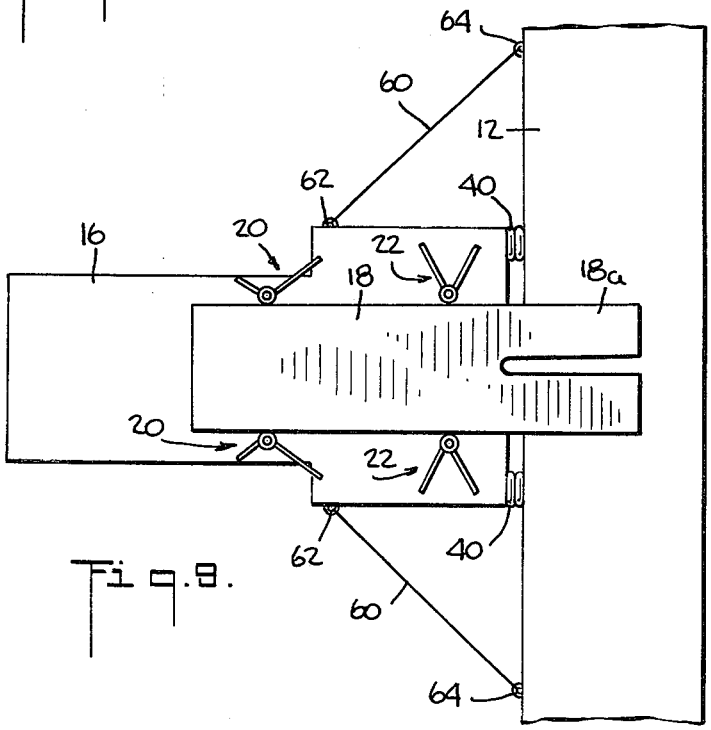
FIG. 9 is a top plan view of the barge system of FIG. 8.
Figure 9:
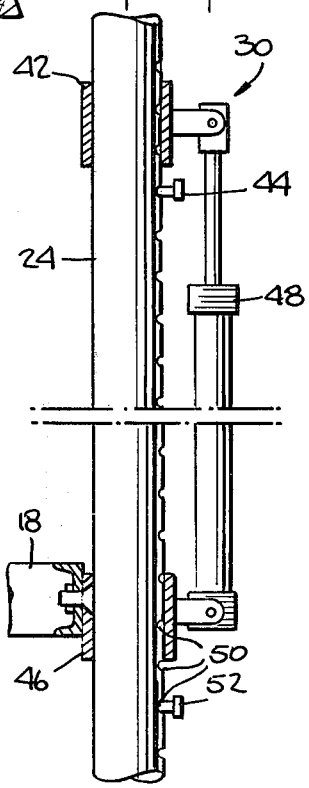

FIG. 9 illustrates the manner of mooring the barge system to the dam wall 12. As can be seen, there are provided mooring cables 60 which extend from cleats 62 on opposite sides of the barge to anchors 64 on the dam wall.

It will be apprciated that if during a repair operation, the water level should begin to change to a greater amount than can be compensated by the pivoting ability of the sleeves 46 at the platform 18, such change may be compensated by adjustment of the hydraulic piston and cylinder assemblies.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A device for use in the repair of dam walls, said device comprising a barge, means for mooring said barge with one edge lying adjacent a dam wall, a platform carried by said barge, said platform having a portion thereof extending but from said barge past said one edge, forward and rearward platform lifting means positioned on said barge near to and back from said edge respectively, said platform lifting means being arranged to lift said platform off from the upper surface of said barge and above the dam wall prior to mooring and to lower the platform down onto said dam wall after mooring, means for engaging and disengaging said forward platform lifting means with the platform after the platform is so lowered and means pivotally interconnecting said platform to said rear lifting means to permit pivoting of said platform with respect to said barge, whereby after said platform is lowered onto the dam wall, the detachable engaging and disengaging means is disengaged so that the weight of the platform is carried by the dam wall and the rearward lifting means and wherein minor fluctuations in water level are compensated for by the pivotal connection.

2. A device according to claim 1 wherein said lifting means each include hydraulic piston and cylinder assemblies for lifting and lowering said platform and locking means for maintaining said platform at a given level independently of the hydraulic piston and cylinder assemblies.

3. A device according to claim 1 wherein said lifting means each comprise a vertical column extending upwardly from said barge, an upper and lower sleeve on said column and interconnected by a hydraulic piston and cylinder assembly, at least one of the sleeves being slideable along the column, said sleeve being secured to the platform.

4. A device according to claim 3 wherein both said sleeves are slideable along said column and wherein said sleeves are adapted to be secured to different locations along the length of said column.

* * * * *

UNITED STATES PATENT OFFICE

CERTIFICATE OF CORRECTION

Patent No. 3931778 Dated February 18, 1976

Inventor(s) EDWARD E. MILLER ET AL.

It is certified that error appears in the above-identified patent and that said Letters Patent are hereby corrected as shown below:

Column 2, line 57, after "a pair of" delete "a pair";

Column 4, line 7, after "hull 16" add --near--;

Column 4, line 32, "approached" should be --approaches--;

Column 4, line 44, delete "of" and add --by--;

Column 5, line 9, after "extending" delete "but" and add --out--.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*